United States Patent [19]

Cukier et al.

[11] Patent Number: 4,469,585

[45] Date of Patent: Sep. 4, 1984

[54] OXIDATION RESISTANT PITCHES

[76] Inventors: Samuel Cukier, 27 Newgate Rd., Toronto, Ontario, Canada, M6B 3G5; Henry A. F. L. Kremer, 52 Langstaff Rd. West, Thornhill, Ontario, Canada, L4J 1M1

[21] Appl. No.: 492,697

[22] Filed: May 9, 1983

[51] Int. Cl.[3] ..... C10C 1/00; H01B 1/04

[52] U.S. Cl. ..... 208/39; 208/22; 208/44; 585/3

[58] Field of Search ..... 208/39, 44, 22; 423/447.2, 447.4, 447.6, 449; 252/502, 506, 510; 585/3

[56] References Cited

U.S. PATENT DOCUMENTS

| | | | |
|---|---|---|---|
| 2,093,450 | 9/1937 | Jacobsohn | 208/22 |
| 2,465,960 | 3/1949 | van den Berge | 208/39 |
| 2,864,760 | 12/1958 | Croy | 208/44 |
| 3,275,585 | 9/1966 | Baum | 208/44 |
| 3,702,832 | 11/1972 | Nikolaerich | 423/447.2 |
| 3,853,773 | 12/1974 | Martin et al. . | |
| 4,070,446 | 1/1978 | Horikiri | 423/447.2 |
| 4,146,576 | 3/1979 | Wyss | 423/447.4 |
| 4,154,807 | 5/1979 | Kishimoto et al. | 423/447.6 |
| 4,298,396 | 11/1981 | Limonchik et al. | 208/44 |
| 4,336,022 | 6/1982 | Lynch et al. | 423/447.2 |

FOREIGN PATENT DOCUMENTS

| | | | |
|---|---|---|---|
| 130343 | 3/1946 | Australia | 208/44 |
| 131858 | 3/1946 | Australia | 208/44 |
| 865320 | 4/1961 | United Kingdom . | |

*Primary Examiner*—Delbert E. Gantz
*Assistant Examiner*—Helane E. Maull

[57] ABSTRACT

A new oxidation-resistant pitch composition is obtained by treating in the molten state a coal tar or petroleum pitch with at least one pitch-soluble and compatible alkyl-aryl sulfonic acid or some salts thereof in an amount of less than 1% of said pitch, with a pitch suitable for making an electrode treated that way, upon subsequent carbonization in conjunction with petroleum coke, an electrode can be formed, with great resistance to oxidation, and with very little dusting. Due to increased coking value of the pitch, the fuming is decreased both during the art of making electrodes and during the use of same in the actual electrolysis thus providing environmental benefits. Such a pitch may also be used as a refractory material.

8 Claims, No Drawings

OXIDATION RESISTANT PITCHES

FIELD OF THE INVENTION

This invention relates to coal tar and petroleum pitches hereinafter referred to as pitches, and to the process of making same. This invention is particularly directed to pitch compositions which are more resistant to oxidation, and preferable to those yielding more stable, less porous anodes producing less fumes and less gasification, and or to piches used as refractory materials.

BACKGROUND OF THE INVENTION

A preponderant number of applications which entail the use of coal tar or petroleum pitches require the carbonization of the pitch material. Examples of carbonization processes include coking and graphitization. During the carbonization process, it is normal to lose between 25 and 65% of the binder, the exact loss being dependent on the volatile content of the pitch. The loss of volatiles to the environment is additionally undesirable in that they constitute a source of air pollution. It is common practice in the industry to indicate this weight loss by the fraction of the starting material which remains upon carbonization, eg. the fraction of the material remaining upon coking is called the "coking value" of the pitch. This is particularly important when the pitch is used as a binder in the formation of coked carbon bodies.

Generally a carbon electrode is a two-phase or binary carbon system consisting of a petroleum coke filler (an aggregate with a specific size distribution) whose particles are bound by a pitch coke phase (called binder pitches) which is developed during carbonization of the electrode paste. In aluminum production, the carbon particles desintegrate from the working surface of an anode by selective oxidation of the binder pitch and thus form carbon dust. The binder pitch phase of anodes is consumed preferentially during oxidation, both electrolytically and chemically; this also results in dusting and the net effect is that carbon consumption is significantly more than the stoichiometric requirement sometimes doubling the stoichiometric amount. This is a substantial amount, if one considers that 83–90% of the anode is carbon filled.

Also a problem encountered with baked carbon bodies obtained from pitches is their relatively high oxidation rate, particularly noticeable when they are used as refractory materials or as electrodes. This oxidation rate can be attributed to such factors as the porosity of the carbon body, its specific surface and the inorganic impurities present in the carbon body.

Techniques hitherto employed to decrease this oxidation rate include pressure impregnation of coating of previously baked carbon bodies with aqueous solutions of oxidation retardant materials such as phosphates, silicates, etc., after which the carbon bodies are rebaked to drive away the moisture. While the former technique requires pressure treating equipment and large volumes of an often expensive impregnant, neither technique succeeds in inhibiting oxidation throughout the interior of the carbon body.

British Pat. No. 865,320 teaches adding oxidation inhibitors to the coke filler-pitch mix before baking. This technique however, requires 4 to 20% weight of the corresponding mix, of the additive. This is expensive in comparison to the base material being treated.

Such large amounts of additive may have a deleterious effect if the resulting carbon body is used for making an electrode. During electrolysis such additives are normally incombustible and constitute a substantial portion of the electrode which may form residues and contaminate the system.

Also U.S. Pat. No. 4,298,396, dated Nov. 3, 1981 as invented by Limonchik et al, describes systems improving oxidation resistance of anodes in such systems however, dusting is not improved.

BRIEF DESCRIPTION OF THE PRESENT INVENTION

It is therefore the object of the present invention to provide a more resistant pitch composition which has increased coking value. It is also an object of this invention to provide a pitch which upon carbonization yields a carbon body having improved oxidation resistance.

Another object of the invention is to decrease the rate of oxidation of carbon bodies and in particular of carbon electrodes used in the aluminum industry.

Still another object of the invention is to reduce the dusting.

Another object of the invention is to reduce the consumption rate of the carbon electrode that is of both the pitch coke carbon which provides the binder phase and the filler carbon, thereby achieving considerable savings.

Broadly stated the invention is directed to a pitch composition having a good resistance to oxidation, comprising:

(a) a pitch material, and (b) an effective amount of an active component comprising at lest one member selected from the class consisting of alkyl-aryl sulfonic acid, and alkyl-aryl sulfonates, said member being compatible with and soluble in said pitch said active component being intimately blended in said pitch material and, wherein said effective amount of said active component is less than 1% by weight of said pitch material, and wherein the alkyl group of said aryl sulfonic acid or aryl sulfonate is a member selected from the class consisting of branched and unbranched alkyl members having from one to four carbon atoms and the sulfonates are salts of the metals selected from the class consisting of groups 1 and 2 of the periodic table, and ammonium.

The invention is also directed to the process for making a pitch. The invention is directed to the improvement which comprises treating in the molten stage a pitch composition with an effective amount of said active component comprising at least one member selected from the class consisting of alkyl-aryl sulfonic acid or some salts thereof, said member being compatible with and soluble in said molten pitch composition.

By soluble in said pitch is meant that the active component must dissolve in the molten pitch.

By the expression "said member compatible with said pitch" is meant a member which will not add atoms or molecules detrimental to anodes or to the electrolytic bath. Examples of such compatible members include: pitch-soluble alkyl-aryl sulfonates of the aromatic family, that is those containing rings such as anthracene, naphthalene, benzene of the alkyl-aryl sulfonates family such as alkyl-benzene sulfonates, alkyl-naphthalene sulfonates and alkyl-anthracene sulfonates and homologues where the cation is at least one member selected from the class consisting of metals of groups 1 and 2 of the periodic table as well as ammonium and preferably sodium, potassium, ammonium ion and the like; and the alkyl is a branched or unbranched chain having between 1 and 4 carbon atoms.

DETAILED DESCRIPTION OF THE PREFERRED EMBODIMENTS

The preferred sulfonated members of the active component are the sulfonated naphthalene compounds and homologues which are preferably used in amounts of the order of ppm, for instance 200 to 5000 ppm. This amount may vary widely according to the pitch used, and the temperature and other experimental conditions, but is generally less than 1%. The treatment must be made above the softening point of the pitch but generally below 200° C., in order to avoid premature degradation of the sulfonic acid in the sulfonate.

The treatment is generally made by mixing the softened pitch with the active component with or without other additives, such as those used in the making of electrodes or refractory materials. For instance in the making of electrodes, the treatment can be made when coke is mixed with the binding pitch: For instance, the pitch material may be a binder pitch for electrodes which is mixed with coke prior to melting.

The following examples will serve to illustrate the invention.

EXAMPLE 1

In a series of experiments sulfonated naphthalene compounds known under the trade mark "CEDEPON AT-400" TM were added in various concentrations ranging from 300 to 2000 ppm based on the total weight of the pitch, mixed in the heated liquid pitch at about 180° C. Mixing time was half an hour.

Surprisingly an increase in the softening point (as determined by the cube in air, ASTM D-2319), and an increase in coking value (as determined by the British Standard of Testing Tar and its Products PT 10-79) were found as shown in table 1 herein below.

TABLE 1

| | Untreated Pitch | Pitch with 500 ppm "CEDEPON AT 400" TM | Pitch with 2000 ppm "CEDEPON AT 400" TM |
|---|---|---|---|
| Softening Point (°C.) | 105° | 106.5–107. | 107.5° |
| Coking Value % | 57 | 60.23 | 62 |
| Specific Gravity | 1.33 | 1.33 | 1.33 |

EXAMPLE 2

The following example is illustrative of the physical properties of the new pitch composition.

Pitch Preparation

Aluminum Grade Flaked Coal Tar Binder Pitch was melted carefully without overheating and kept at a temperature of 180° C.±5° C. The sulfonated naphthalene available under the Trademark "CEDEPON", in concentrations of 1000 ppm, was added to the continuously agitated molten pitch and mixed up for 30 minutes until visual homogeneity then cooled and broken up to lumps. The physical properties of the new pitch composition at 1000 ppm were measured and compared against the physical properties of the untreated pitch compositions. Results are shown in Table 2 hereinbelow.

TABLE 2

PHYSICAL PROPERTIES OF BINDER PITCHES

| PROPERTY | PITCH MATERIAL | PITCH MATERIAL + ADDITIVE (1000 ppm) |
|---|---|---|
| Softening Point (°C.) (ASTM D-2319) | 101 | 101 |
| Specific Gravity (ASTM D-71) | 1.32 | 1.35 |
| Xylene Insoluble (%) (ASTM D-2317) | 33.6 | 35.4 |
| Quinoline Insoluble (%) (ASTM D-2318) | 19.5 | 19.5 |
| Coking Value (%) | 59 | 62 |
| Ash Content (%) (ASTM D-2415.66-1976) | 0.29 | 0.3 |

EXAMPLE 3

The following example is illustrative of the typical oxidation resistance of the new pitch compositions.

Electrode Preparation and Testing

All experiments used "Domtar" Aluminum Grade Binder Pitches. In the first group of experiments, small electrodes were prepared with a North American commercially used petroleum coke by using various recipes. The levels of the sulfonated naphthalene "CEDEPON AT 400 TM" included in the mixture were varied in an industrial formula. Small electrodes (10 mm diameter) were extruded and baked.

In a different series of experiments, electrodes were produced in a Pilot Plant based on a European standard petroleum coke. The anodes were baked after moulding. Test cylinders were then cut from the various electrodes for testing, as disclosed in A. M. Odok and W. K. Fischer, "Application of Pilot Plant Work in Prebaked Anode Manufacturing", pp. 269–286 in *Light Metals*, Vol. 1, John J. Miller, ed.: A.I.M.E., New York, N.Y., 1978.

The electrode consumption tests were conducted in a furnace at approximately 960° C. for 7 hours, passing a measured amount of carbon dioxide through the furnace. Other physical properties have been determined by standard testing methods.

TABLE 3

ELECTRODE REACTIVITY WITH CARBON DIOXIDE (960° C. for 7 HRS.)

| ADDITIVE LEVEL (ppm) | BUTTS (%) | RESIDUE (%) | DUST (%) | GASIFICATION (%) |
|---|---|---|---|---|
| 0 | 0 | 35 | 17 | 48 |
| 1000 | 0 | 62 | 11 | 27 |
| 2000 | 0 | 48 | 8 | 44 |
| 0 | 30 | 40 | 17 | 43 |
| 1000 | 30 | 54 | 10 | 36 |
| 2000 | 30 | 66 | 8 | 26 |

It was found that applicant's novel pitch compositions were the most resistant to carbon dioxide at high temperatures in comparison with other North American binder pitches supplied to aluminum manufacturers. Tests have been carried out at various additive levels with improved results. (Table 3). At 2000 ppm additive level, the anode residue increased by 65% and the dusting decreased by 53% at 30% Butts level in the mix.

TABLE 4

ELECTRODE REACTIVITY (CARBON DIOXIDE AT 960° C. FOR 7 HRS.)

| LEVEL OF SULFURATED NAPHTALENE (ppm) | BUTTS (%) | RESIDUE (%) | DUST (%) | GASIFICATION (%) |
|---|---|---|---|---|
| 0 | 0 | 59 | 9 | 32 |
| 0 | 30 | 40 | 17 | 43 |
| 1000 | 30 | 54 | 10 | 36 |
| 2000 | 30 | 66 | 7 | 27 |

In the second series of experiments, a different batch of Pitch was used and $CO_2$ reactivity tests were carried out similarly to the first series of experiments and purposely with the addition of butts. The results as shown in Table 4 indicate that the addition of 30% Butts have deteriorated the anode performance significantly (32% drop in residue and 89% increase in dusting). The usage of additive however, compensated for the losses; at 1000 ppm additive level the reactivity and dusting has returned to normal level (i.e., when no Butts had been used); at 2000 ppm additive level, the improvements were even greater and 12% increase of the residue and over 20% decrease in dusting has been achieved over the standard anode made without butts.

Determination of deleterious key elements (i.e. sulfur, phosphorus, silica, etc.) in the electrode, as is known in the prior art indicated that no increase had been detected in these elements from the sulfonated active component.

In summary the alkyl-aryl sulfonated active component has clearly demonstrated its effectiveness in improving the quality of the electrode. Significant improvements could be achieved by using the active component described above, in a recipe utilizing a less than inert petroleum coke filler. The amount of gasification and dusting has been reduced, thereby increasing the yield of aluminum production with the improved electrode. The realization of these benefits would be of great economic advantage, compensating for the ever increasing reactivity of regular petroleum cokes.

The pitches described hereinabove because of their improved physical properties may also be advantageously used as refractory materials, as is known by those skilled in the art.

Modification may be made without departing from the spirit of the invention as defined in the appended claims.

We claim:

1. A pitch composition having resistance to oxidation, comprising:

(a) a pitch material, and (b) an effective amount of an active component comprising at least one member selected from the group consisting essentially of alkyl-aryl sulfonic acid, and alkyl-aryl sulfonates, said member being compatible with and soluble in said pitch, said effective amount of said active component is less than 1% by weight of said pitch material, and wherein the alkyl group of said aryl sulfonic acid or aryl sulfonate is a member selected from the group consisting of branched and unbranched alkyl members having from one to four carbon atoms and the sulfonates are salts of the metals selected from the group consisting of groups I and II of the periodic table, and ammonium.

2. The pitch composition as defined in claim 1 wherein said member is selected from the group consisting of alkyl naphthalene sulfonates of sodium, potassium and ammonium, and wherein said alkyl member is selected from the group consisting of branched and unbranched alkyl members having from 1 to 4 carbon atoms.

3. The pitch composition as defined in claim 1 or 2 wherein said member is present in an amount between 100 and 5000 ppm of said pitch composition and where said pitch composition has reduced porosity, greater resistance to oxidation, higher coking values, less gasification and dusting, as compared to said pitch material.

4. A process for making a pitch composition having reduced porosity, resistance to oxidation, higher coking value, less gasification and dusting, relative to said pitch material, which comprises: treating a pitch material with less than 1% by weight of active component comprising of at least one member selected from the group consisting essentially of alkyl-aryl sulfonic acid, and alkyl-aryl sulfonates, said member being compatible with and soluble in said pitch when in a molten state, and melting said treated pitch in order to obtain said improved pitch, wherein the alkyl group of said aryl sulfonated acid or aryl sulfonates is a member selected from the group consisting of branched and unbranched alkyl members having from 1 to 4 carbon atoms, and wherein the sulfonates are salts of the metals selected from the group consisting of groups I and II of the periodic table, and ammonium.

5. The process as defined in claim 4 wherein said member is an alkyl-aryl sulfonate.

6. The process as defined in claim 4 wherein said member is selected from the group consisting of alkyl-anthracene sulfonates and alkyl-naphthalene sulfonates.

7. The process as defined in claim 4, 5 or 6 herein said member is present in an amount between 100–5000 ppm of said pitch.

8. The process as defined in claim 4, 5 or 6 wherein said metals are an alkyl-aryl sulfonate having an ion selected from the group consisting of sodium, potassium and ammonium.

* * * * *